United States Patent [19]

Long

[11] 4,305,343

[45] Dec. 15, 1981

[54] POLYMER COATED CHAIN LINK FENCING

[75] Inventor: Clyde A. Long, Hyattsville, Md.

[73] Assignee: Sonco Wholesale Fence, Inc., Bladensburg, Md.

[21] Appl. No.: 123,936

[22] Filed: Feb. 25, 1980

[51] Int. Cl.[3] ..... B05C 19/02

[52] U.S. Cl. ..... 118/44; 118/419; 118/427; 118/DIG. 5; 427/185; 427/195; 427/434.4

[58] Field of Search ..... 427/185, 195, 434 B; 118/44, 56, 309, 308, 419, 423, 424, 427, 428, DIG. 5

[56] References Cited

U.S. PATENT DOCUMENTS

| | | | |
|---|---|---|---|
| 1,489,076 | 4/1924 | Harter | 118/428 X |
| 1,623,593 | 4/1927 | Harter | 118/419 X |
| 1,689,792 | 10/1928 | Meaker | 118/428 X |
| 2,576,372 | 11/1951 | Toulmin et al. | 427/434.4 X |
| 2,933,410 | 4/1960 | Brightly | 118/419 X |
| 3,354,013 | 11/1967 | Terrell et al. | 427/185 X |
| 3,742,106 | 6/1973 | Price | 427/185 X |
| 3,807,355 | 4/1974 | Goldberg | 118/DIG. 5 |
| 3,817,211 | 6/1974 | Brown | 118/423 X |
| 3,861,594 | 1/1975 | Wendling | 118/326 X |
| 4,013,807 | 3/1977 | Putney | 427/184 |
| 4,035,521 | 7/1977 | Westervelt | 427/32 |
| 4,059,926 | 11/1977 | Rampe | 118/419 X |

FOREIGN PATENT DOCUMENTS

| | | | |
|---|---|---|---|
| 604198 | 4/1978 | U.S.S.R. | 427/185 |

*Primary Examiner*—Shrive P. Beck

*Attorney, Agent, or Firm*—John T. Roberts; Donald E. Stout

[57] ABSTRACT

A method for polymer coating of chain link fence is disclosed. The thermoplastic polymer is applied in a fluidized bed after the fence is woven. The fence is compressed in the fluidized bed to allow coating of all portions of the chain link.

1 Claim, 5 Drawing Figures

POLYMER COATED CHAIN LINK FENCING

CROSS-REFERENCE TO RELATED APPLICATIONS

This invention is not disclosed in any co-pending application for patent or any issued patent.

BACKGROUND OF THE INVENTION

This invention is an improvement in fencing structures and particularly an improvement in the woven or chain link fencing structures.

For over fifty years chain link fencing, after being woven, has been dipped in zinc to produce a galvanized coating. This galvanized coating inhibits the formation of rust.

During the last twenty years a far more enduring rust-preventative has been developed. This rust-preventative is a polymer coating for articles. One of the most effective ways of applying these polymer coatings is the use of powdered polymers in a fluidized bed. This technology has achieved widespread acceptance for coating a variety of articles.

Prior efforts to coat chain link fence have been frustrated by the fact that the chain link, in the fluidized bed, has had the adjoining links in contact with the result that the powdered polymers do not adhere to the entire surface of the chain link. Each such contact spot has proved a site for rust to develop and has caused the fence to deteriorate rapidly.

An effort to achieve the advantage of powdered polymer coating on chain link, while overcoming the above difficulty, has been made. This effort involved coating the single strand of wire prior to weaving it into the chain link. This approach has not worked because the wire must be repetitively cut into lengths about one and a half times the height of the fence. There will be bare ends of wire at both top and bottom approximately every two inches of fence line. Since this wire is exposed, rusting begins rather rapidly.

An effort has been made to overcome this problem by using galvanized wire prior to the polymer coating. This approach also has limitations because the exposed end, while rusting more slowly, will still rust and the galvanizing, which involves heating, lowers the strength of the wire forming the fence.

The coating of the entire chain link fence with no bare spots has long been recognized as a need in galvanizing operations. U.S. Pat. No. 1,623,593 to Harter, shows a system for compressing the links and thereby separating the points of contact after the chain has been dipped in the galvanizing bath. As is well known, molten zinc has very low viscosity and it will flow smoothly over adjacent metal as it comes out of a galvanizing bath.

A different method of achieving this result is shown in U.S. Pat. No. 2,933,410 to F. C. Brightly, Jr. Broadly, this patent discloses removing the chain link from the galvanizing bath, running it around a roller to break the welds caused by the solidified zinc, reintroducing the chain link to the galvanizing bath and withdrawing it again to assure uniform coating and no welding.

A simplified batch processing fluidized bed tank is disclosed in U.S. Pat. No. 3,807,355 to Newton N. Goldberg. A fluidized bed coating tank, in its simplest terms, blows air through a foraminous screen to heat thermosetting polymer particles to above their fusion temperature and the article to be coated is lowered into this apparent sea of floating warm particles. The particles adhere to the article at which point they polymerize and harden.

Another version of the fluidized bed is the electrostatic fluidized bed. This type of system is disclosed in U.S. Pat. No. 4,088,093 to Peter N.Y. Pan, in which a charge is placed on the article to be coated and the polymer is drawn to it both by the force of the air and the electric charge.

A particular type of this electrostatic fluidized bed is disclosed in U.S. Pat. No. 3,817,211, to Brown et al. This discloses a machine for coating a multi-filament strand in which the strands are mechanically separated by running them over a roller and the filaments are further separated by applying an electrostatic charge causing the fibers to repel each other. The thermosetting polymer is thus allowed to strike and adhere to each portion of the individual fibers rather than merely coating the periphery of the completed strand.

DESCRIPTION OF THE INVENTION

The invention will be described with respect to a particular embodiment as disclosed in the attached drawings in which FIG. 1 is a partially diagrammatic flow chart of the fluidized bed operation, FIG. 2 is a top view of a portion of chain link fencing taken on lines 2—2 of FIG. 1, FIG. 3 is a portion of chain link fencing taken on lines 3—3 of FIG. 1, showing the strands separated during the fluidized operation, FIG. 4 is an enlarged detail of FIG. 1, taken on lines 4—4 of FIG. 3, and, FIG. 5 is an enlarged detail taken on lines 5—5 of FIG. 3.

DESCRIPTION OF THE PREFERRED EMBODIMENT

Figure 1:
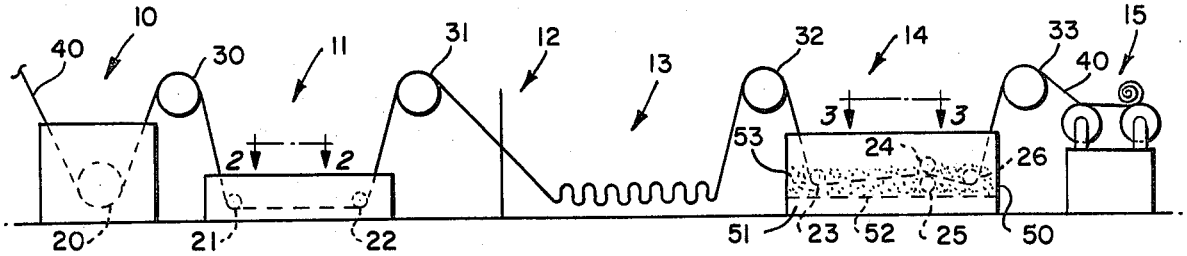

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
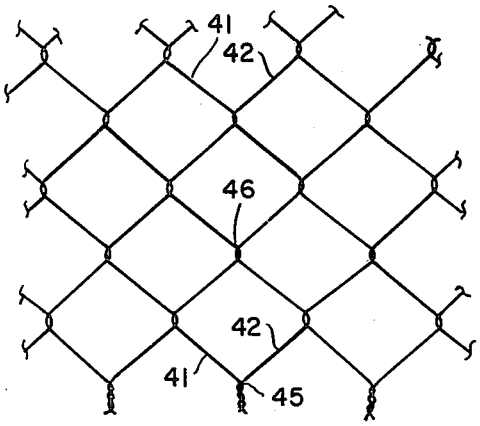
Figure 3:
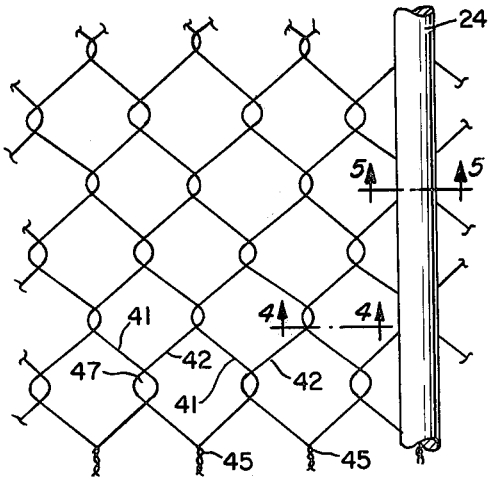
Figure 4:
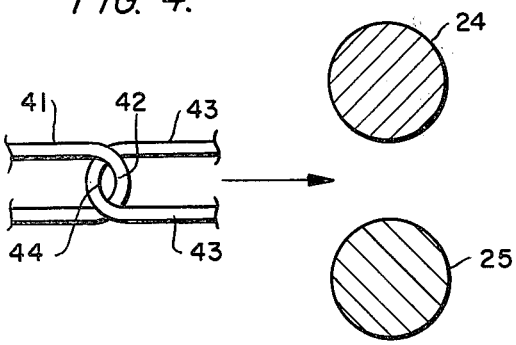
Figure 5:
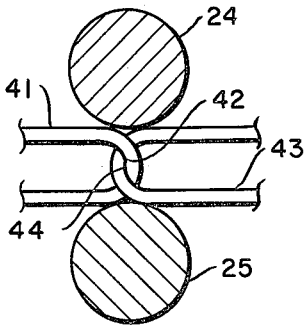

As shown best in FIGS. 2 and 3, a chain link is woven by taking two wires 41, 42, twisting them as shown at 45 and then weaving them together and with the previously woven wire to create an additional link or course the width of the chain. The chain link is woven to the final width desired, usually from 3 to 12 feet. When the chain is mounted in place on uprights, horizontal tension keeps the joints 46 closed.

As shown in FIG. 3, the chain link may easily be compressed and the joints separated as at 47, with only the twisted end portions 45 remaining permanently adhered to each other.

The elements of my fluidized bed dryer are shown in FIG. 1 in which the woven chain link 40 travels from left to right. The woven wire goes first through a cleaning station 10, then a heating station 11, then is primed at 12, accumulated at 13, passes the fluidized bed 14 to the take-up station 15.

I employ two types of rollers for the chain link during this operation. First are plain rollers whose only purpose is to hold the wire in position and change its direction, such as roller 20 in the cleaning station, and rollers 21 and 22 in the heating station. Interspersed are drive rollers such as 30 pulling the chain link out of the cleaning station and 31 pulling it out of the heating station. These drive rollers may have a conventional cleat arrangement to fit in the chain link, such as disclosed in the above cited Harter patent.

A drive roller 32 feeds the chain link into the fluidized bed and drive roller 33 removes it from the fluidized bed where it is rolled up again at take-up station 15.

The accumulation stage 13 allows the prime coat to dry and also allows for some slack between the cleaning, heating and priming stages and the fluidized bed, since the tension in the fluidized bed is critical and is not critical in the stages prior thereto.

In the fluidized bed are four rollers 23, 24, 25, and 26. Rollers 23 and 26 serve to change the direction of the chain link while rollers 24 and 25 are compression or squeeze rollers which may be separated to insert the chain but are then biased by conventional means not shown towards each other to squeeze the chain.

Drive rollers 32 and 33 are indexed to slightly compress the chain, or relieve tension, during the passage through fluidized bed dryer 14. Roller 32 starts first for a selected displacement and then roller 33 begins. During operations both rollers operate at the same speed. As each link is passed between squeeze rollers 24 and 25, the force of the rollers holds the links so that inner surfaces 42 and 44 between roller 23 and rollers 24 and 25 are separated due to the above described indexing allowing the powder polymer to coat them and adhere to the surface prior to the surfaces again contacting each other forming flexible joint 46 as shown in FIG. 2.

The fluidized bed dryer may be of any conventional type, comprising a tank-like vessel 50 containing at the bottom an air plenum 51 into which heated air is pumped through conventional heating and valving means not shown. Above the air plenum is a porous or foraminous plate 52 which separates the air into vertical streams. Into this area above plate 52 is inserted, through conventional means not shown, the thermoplastic polymer which is heated to near its fusing point, as is well known.

The powdered polymer adheres to the heated chain link fabric as it passes under rollers 23, past rollers 24, 25 and under roller 26. This occurs because the air pressure is sufficient to raise the cloud of semi-molten polymers above the level of the above-mentioned rollers, creating an apparent fluidized bed of these partly molten polymer powders.

As the polymer coated fabric exits from the fluidized bed, cooling streams of air, not shown, may be advantageously applied to the chain link fabric to cool the coating and strengthen it prior to passage over drive roller 33 and the rolling operation at take-up station 15.

Although the present invention has been described with reference to a particular embodiment thereof, it should be understood that those skilled in the art may make many other modifications and embodiments thereof which will fall within the spirit and scope of the principles of this invention.

What is claimed as new and desired to be secured by patent of the United States is:

1. A machine for applying heated polymer powder to a chain link fence comprising:

(a) a means to heat the chain link fencing, (b) an initial drive roller to introduce the chain link to the machine, (c) selectively disengageable means to drive said initial drive roller, (d) a fluidizing bed vessel having a lower air chamber, a porous air plate above said chamber and a portion above the plate for the polymer powder and the chain link, (e) a second drive roller to remove the chain link from the machine, (f) selectively disengageable means to drive said second drive roller, (g) control means interconnecting said first and second drive means to allow the chain link to be compressed within said machine, (h) guide means to hold the said chain link below the level of the top of the fluidized bed during the passage through the machine, (i) a pair of compression rollers within said machine below said level of the top of said fluidized bed which compress said chain link and separate the links of the chain before they pass between said compression rollers, whereby the entire chain link fabric is covered by the polymer powder during the passage through the machine.

* * * * *